United States Patent [19]

Farrell

[11] Patent Number: 5,063,905

[45] Date of Patent: Nov. 12, 1991

[54] PNEUMATIC GUN

[76] Inventor: Kenneth R. Farrell, 19202 SE 184th St., Renton, Wash. 98058

[21] Appl. No.: 579,057

[22] Filed: Sep. 6, 1990

[51] Int. Cl.[5] ..... F41B 11/00

[52] U.S. Cl. ..... 124/72; 124/74; 124/76

[58] Field of Search ..... 124/70, 71, 72, 73, 124/74, 76, 56

[56] References Cited

U.S. PATENT DOCUMENTS

| | | | |
|---|---|---|---|
| 2,505,972 | 5/1950 | Johnson | 124/76 |
| 2,554,116 | 5/1951 | Monner | 124/76 X |
| 2,817,328 | 12/1957 | Gale | 124/74 |
| 2,940,438 | 6/1960 | Merz | 124/74 X |
| 3,103,212 | 9/1963 | Merz | 124/11 |
| 3,177,863 | 4/1965 | Spack | 124/11 |
| 3,547,095 | 12/1970 | Vadas | 124/11 |
| 3,612,026 | 10/1971 | Vadas | 124/74 X |
| 3,788,298 | 1/1974 | Hale | 124/11 |
| 3,824,981 | 7/1974 | Crane et al. | 124/11 |
| 4,531,503 | 7/1985 | Shepherd | 124/76 |
| 4,602,608 | 7/1986 | Lacam et al. | 124/74 |
| 4,819,609 | 4/1989 | Tippemann | 124/72 |
| 4,936,282 | 6/1990 | Dobbins et al. | 124/74 |

*Primary Examiner*—Peter M. Cuomo
*Assistant Examiner*—Jeffrey L. Thompson

[57] ABSTRACT

A pneumatic gun incorporating a striker (50) moving in response to the urging of a compressed power spring (77) from a cocked position in a striker chamber (46) to impact on a primary valve assembly (80) and thereby effect the release of compressed gas for propelling a projectile from the gun and for recocking the striker (50) is disclosed. The primary valve assembly (80) incorporates a single full-pressure main valve (87) for regulating the release of all compressed gas, and a unidirectional low pressure secondary valve (88) for providing a portion of the compressed gas released by the main valve to the striker chamber (46) for urging the striker (50) to move back to the cooked position. The striker (50) incorporates a striker poppet valve (70) which permits gas to escape from the striker chamber (46) as the striker (50) moves to impact on the primary valve assembly (80), and which seals the striker chamber (46) against premature loss of the compressed gas which is urging the striker (50) back toward the cocked position.

27 Claims, 10 Drawing Sheets

PNEUMATIC GUN

BACKGROUND OF THE INVENTION

The present invention relates to pneumatic guns of the semiautomatic or automatic type. The invention is particularly useful for firing marking pellets, also known as paintballs, but may also be employed for firing other projectiles such as darts, metallic pellets, or B-Bs.

The invention offers advantages of efficiency in the utilization of the propellent used by the gun, and of maintainability. Inefficient use of the propellent available to power a pneumatic gun is detrimental, reducing the number of shots which can be fired from a given supply. In addition, in the typical application where the propellent is initially in the liquid state and is converted to gas to power the gun, inefficiency also reduces the number of effective shots which can be fired over a short interval of time. The latter reduction occurs because each release of propellent to fire the gun requires heat to convert propellant fluid, typically liquid carbon dioxide, from liquid to gas. This heat loss causes a slight reduction in temperature of the remaining propellant fluid and a corresponding reduction in gas pressure available to continue operation of the gun. With rapid multiple shots this reduction in gas pressure can be sufficiently large, particularly in an inefficient gun, to significantly reduce projectile velocity, or even to prevent the gun from recocking until the propellent fluid has rewarmed.

It is previously known in the art to have semiautomatic or automatic pneumatic guns. Representative of this art are Tippmann, U.S. Pat. No. 4,819,609 (1989) and Merz, U.S. Pat. No. 3,103,212 (1963). Such pneumatic guns generally incorporate a gun frame, a grip, a barrel, a magazine of projectiles with a feed assembly for introducing a single projectile into position for firing, a source of compressed gas, a striker, a striker power spring, an operator actuable trigger mechanism with a sear for restraining the striker in a cocked position, and at least one valve, openable upon impact by the striker, for regulating release of compressed gas at the full pressure of the compressed gas source. During the firing phase of gun operation, the striker moves in response to urging by the striker power spring from the cocked position to a position of impact on the regulating valve, briefly opening the valving.

Also required to initially prepare the gun for firing is a method for manually moving the striker to the cocked position. A bolt for sealing the feed assembly against loss of the compressed gas released to the projectile then being expelled from the gun may also be present in the gun. In general, pneumatic guns are tuned to provide as high a velocity as can be achieved consistently, or as high a velocity as is permitted in the sporting event in which the gun is to be used.

Double-action trigger mechanisms provide one type of semiautomatic gun, generally with the first portion of trigger movement acting to cock the striker and the remaining portion acting to release the striker from its cocked position. In true semiautomatic and automatic guns, compressed gas released during firing provides the motive force which returns the striker to the cocked position. An automatic gun differs from a semiautomatic gun in not requiring an actuation of the trigger for each successive shot.

In general, the striker of a true semiautomatic or automatic gun functions in two modes, one during the firing phase of operation, and another during recocking. During the firing phase the striker, usually in a cylindrical striker chamber, acts as a hammer moving in response to the urging of a striker power spring from the cocked position to impact on, and briefly open, the regulating valving. During recocking, the striker acts as a piston moving to the cocked position and compressing a striker power spring in response to the force exerted by a charge of compressed gas provided to the striker chamber during firing.

The requirements imposed on these two modes of functioning are different. During the firing phase, the striker chamber should be vented to a region of nominally ambient pressure exterior to the striker chamber, so that striker movement toward the regulating valving is not impeded by gas trapped in the striker chamber ahead of the striker. During recocking the striker chamber should be sealed so that efficient use is made of the energy available from the compressed gas charge.

Merz and others use a single regulating valve, which during firing releases compressed gas into a main channel. One portion of the gas released serves to propel a projectile, and a second portion flows through an unvalved secondary channel to a striker chamber, where it acts to recock a striker. The disadvantage of the secondary channel being unvalved is that some gas in the striker chamber escapes by flowing back out through the secondary channel before contributing fully to recocking, but too late to contribute effectively to propulsion of the projectile, thereby reducing efficiency in utilizing propellent fluid.

Tippmann uses two valves contained in a slidable valve housing, both of which regulate the release of compressed gas at the full pressure of the propellent source. During firing, a striker impacts a first valve, releasing a charge of compressed gas into a striker chamber. In addition to serving to recock the striker, this charge of gas cooperates with the impacting striker to open a second valve which releases gas for expelling the projectile. As a first disadvantage, this doubles the number of full-pressure valves which must be maintained. As a second disadvantage, the initial release of gas for recocking, followed by the release of gas for projectile propulsion, encourages a relatively long total period of gas release. As is known in the art, a longer period of gas release results in less efficient use of the gas to accelerate the projectile being expelled from the gun, and hence results in greater consumption of gas to achieve a specific projectile velocity.

Given the ambient temperature range over which pneumatic guns are expected to operate, and the cooling of the propellent which results from multiple shots fired in rapid succession, the pressure in a propellent fluid reservoir which is not yet exhausted can vary by a ratio of more than 3 to 1. The charge of recocking gas, provided to the striker chamber during firing of a semiautomatic or automatic pneumatic gun, should provide sufficient force to reliably recock the gun at the lower end of this pressure range, but not so much force that gun components are damaged at the higher end.

Generally, variations in source gas pressure are partially compensated for in pneumatic guns according to the art. In these guns, the pressure of the source gas acts on the regulating valve mechanism when it is open and contributes to urging it to close. As a result, when source gas pressure is low the valve mechanism tends to open farther and be open longer during firing, providing more time for gas to enter the striker chamber, thereby compensating partially for the lower pressure. However, the compensation is only partial, as is evidenced by such guns demonstrating significantly greater excess recocking force when the weather is hot than when it is cold. Pressure regulators offer one means of compensating for variations in source gas pressure, but have the disadvantage of increasing gun complexity and hence gun maintenance. A need remains for improvements which will provide reliable recocking over a wider range of source gas pressures without significantly increasing gun complexity.

It is therefore an object of this invention to provide a semiautomatic or automatic pneumatic gun of improved efficiency in which striker motion toward a position of impact on the regulating valve mechanism is not significantly impeded by gas in the striker chamber, and in which compressed gas provided for recocking is not permitted to escape without contributing fully to the recocking process.

Another object is that the gun provide improved efficiency by virtue of permitting a short interval over which compressed gas is released during firing.

Another object is that the gun recock over a wider range of source gas pressures without a significant increase in gun complexity.

Another object is that the gun minimize gun maintenance by use of only a single full-pressure valve.

Further objects and advantages will become apparent from a consideration of the ensuing description and drawings.

SUMMARY OF THE INVENTION

In general, a pneumatic gun of improved efficiency and maintainability is provided in which compressed gas, released from a reservoir during firing, serves both to expel a projectile from the gun and to recock the gun for a subsequent firing operation. The invention incorporates various elements of generally conventional design, including a barrel, a frame, a grip, a reservoir of compressed gas, a striker, an operator actuable trigger mechanism having a sear for restraining the striker in a cocked position against the urging of a striker power spring, a handle for initially cocking the striker, a projectile feed assembly for providing to the gun a projectile to be expelled, and a bolt for sealing the projectile feed assembly against loss of compressed gas released for expelling the projectile.

Release of compressed gas from the reservoir is regulated by a single main valve. The main valve opens briefly during firing upon impact by the striker moving from the cocked position through a cylindrical striker chamber. Maintenance is minimized by this single main valve being the only full pressure valve in the gun.

A portion of the gas released by the single main valve during firing passes through a main channel to the rear surface of the projectile to be expelled, thereby propelling it from the gun. Another portion passes into the striker chamber through a secondary channel which incorporates a unidirectional low pressure secondary valve. This charge of compressed gas within the striker chamber serves to urge the striker back to the cocked position.

The unidirectional nature of the valve in the secondary channel directly improves efficiency in the use of compressed gas by preventing the charge of compressed gas from escaping via the secondary channel. It also permits efficiency to be improved indirectly. The secondary valve seals the secondary channel after charging is completed, allowing the opening provided for charging the striker chamber to be made large, thereby permitting rapid charging without risking loss of the charge. The advantage of rapid charging is that the gun can be tuned to operate with the main valve open for a shorter period, which as is known in the art, improves efficiency.

In the preferred embodiment of the invention, the secondary valve is structurally constrained to move in concert with the main valve, and is configured to open at a varying rate which, as the source pressure decreases, increases the proportion of gas released by the main valve which passes into the striker chamber for recocking the striker. This varying rate of opening more completely compensates for differences in source gas pressure than is possible according to the art, providing the advantage of making recocking reliable over a wider range of source gas pressures.

The valve in the secondary channel operates at low pressure, and is required to restrain gas flow only for the brief period during which the striker is moving back to the cocked position. As a result, it provides the advantage of requiring very little maintenance relative to that required if a second full pressure valve were used to regulate gas for charging the striker chamber.

The combination in the present invention of a single full pressure main valve for the initial release of compressed gas, with a unidirectional low pressure secondary valve for charging the striker chamber, provides very efficient gun operation. A prototype model of the present invention incorporating these features required 50 percent as much compressed carbon dioxide per shot as a gun according to the Tippmann patent referenced previously and marketed by Tippmann Pneumatics, Inc., of Fort Wayne, Ind., as the 68-Special, when the two guns were test fired under equivalent conditions.

The invention further improves efficiency by incorporating valved porting of the striker chamber. The valved porting is open as the striker assembly moves toward the primary valve assembly during firing, enabling gas to vent from the striker chamber ahead of the striker, thereby reducing the impediment to forward movement of the striker. The valved porting is closed as the striker moves substantially back to the cocked position, effectively sealing the striker chamber against premature escape of the recocking gas charge.

In the several embodiments of the invention described herein, the striker chamber valved porting is constantly biased toward the open state by spring urging; it is maintained in a closed state as the striker is urged back toward the cocked position by the compressed gas charge in the striker chamber; and it opens in response to the previously mentioned spring urging when the compressed gas charge is permitted to escape from the striker chamber once recocking is substantially completed. In the preferred embodiment of the invention, the valved porting incorporates a poppet valve within the striker which extends ahead of the striker and is forced closed as the striker impacts on the primary valve assembly. In alternative embodiments described herein, the valved porting is of a different configuration, and closes in response to the pressure of the charge of compressed gas in the striker chamber.

As is apparent from the above description, the invention provides the advantage of a unidirectional secondary valve which, by virtue of operating at low pressure, does not degrade maintainability. In addition, by virtue of permitting a short interval of opening during firing and thus preventing premature escape of the compressed gas made available for recocking, it improves efficiency. The secondary valve further incorporates a varying opening rate, which provides the advantage of more uniform recocking force over a wider range of source gas pressures than is available in the art. Further advantage in the form of improved efficiency is provided by valved porting of the striker chamber, which by venting the striker chamber during firing permits more of the energy stored in the compressed striker power spring to contribute to the impact of the striker on the primary valve assembly, and which by subsequently sealing the striker chamber conserves the gas charge released into the striker chamber for recocking the gun.

Figure 1:
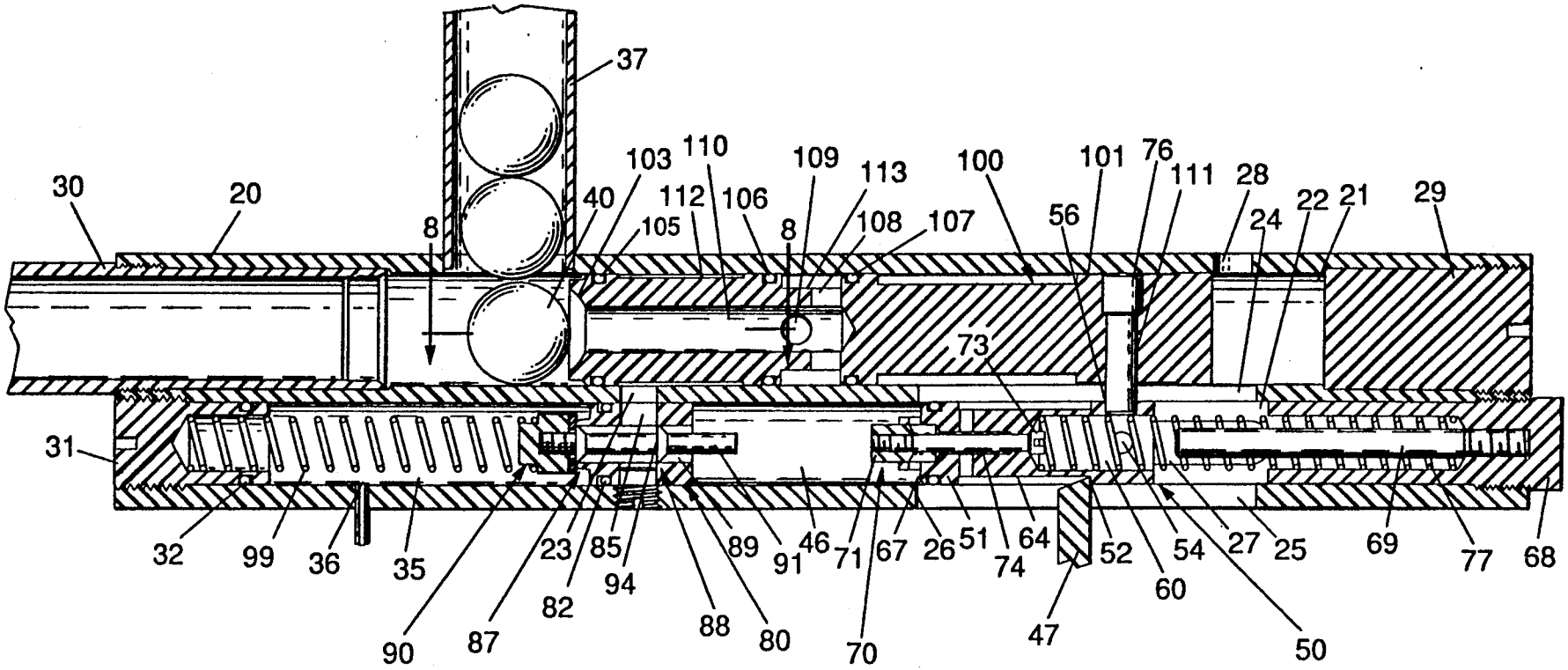
FIG. 1 shows a side cross-sectional view of the gun prepared to fire, with the striker in the cocked position and a projectile in position to be expelled forward through the barrel.

| Reference Numerals in Drawings | |
|---|---|
| 20 | Frame |
| 21 | Upper chamber |
| 22 | Lower chamber |
| 23 | Interchamber hole |
| 24 | Connecting pin slot |
| 25 | Sear access slot |
| 26 | Forward end (of access slot) |
| 27 | Striker handle slot |
| 28 | Connecting pin access hole |

-continued

| Reference Numerals in Drawings | |
|---|---|
| 29 | Upper chamber plug |
| 30 | Barrel |
| 31 | Reservoir plug |
| 32 | O-ring seal |
| 35 | Compressed gas reservoir |
| 36 | Reservoir port |
| 37 | Projectile feed assembly |
| 38 | Valve body locking pin |
| 39 | Valve body locking pin hole |
| 40 | Projectile |
| 42 | Projectile retention spring |
| 43 | Spring tip |
| 44 | Spring screw |
| 45 | Spring slot |
| 46 | Striker chamber |
| 47 | Trigger sear |
| 49 | Main channel |
| 50 | Striker |
| 51 | Striker body |
| 52 | Sear notch |
| 54 | Striker handle attachment hole |
| 55 | O-ring seal |
| 56 | Striker connecting pin hole |
| 57 | Striker body hole |
| 58 | First partial bore |
| 59 | Second partial bore |
| 60 | Third partial bore |
| 61 | Forward transverse port |
| 62 | Intermediate transverse port |
| 63 | Forward reduced diameter portion |
| 64 | Intermediate reduced diameter portion |
| 66 | Rear bore face |
| 67 | Forward full diameter face |
| 68 | Lower rear chamber plug |
| 69 | Lower chamber pin |
| 70 | Striker poppet valve |
| 71 | Poppet valve plug |
| 72 | Poppet valve screw |
| 73 | Poppet valve screw head |
| 74 | Poppet valve spring |
| 76 | Connecting pin |
| 77 | Striker power spring |
| 80 | Primary valve assembly |
| 81 | Valve body |
| 82 | O-ring seal |
| 83 | Main valve seat |
| 84 | Longitudinal valve body hole |
| 85 | Vertical valve body hole |
| 86 | Valve hole intersection |
| 87 | Main valve |
| 88 | Secondary valve |
| 89 | Secondary channel |
| 90 | Main poppet valve |
| 91 | Main valve pin |
| 92 | Main conical element |
| 93 | Secondary conical element |
| 94 | Conical element base |
| 95 | Threaded end portion |
| 96 | Cup seal |
| 97 | Resilient sealing element |
| 98 | Pin impact face |
| 99 | Primary valve spring |
| 100 | Bolt |
| 101 | Bolt body |
| 103 | Forward face |
| 104 | Forward edge of bolt |
| 105 | O-ring seal |
| 106 | O-ring seal |
| 107 | O-ring seal |
| 108 | Vertical transverse bore |
| 109 | Horizontal transverse bore |
| 110 | Longitudinal partial bore |
| 111 | Bolt connecting pin hole |
| 112 | First reduced diameter portion |
| 113 | Second reduced diameter portion |
| 250 | Solid striker |
| 251 | Solid striker body |
| 257 | Forward projection |
| 260 | First pressure actuated valve |
| 261 | First valve frame |
| 262 | Frame cavity |

-continued

| Reference Numerals in Drawings | |
|---|---|
| 263 | Forward orifice |
| 264 | Rear orifice |
| 265 | First transverse port |
| 266 | First valve sphere |
| 267 | Solid striker forward full diameter face |
| 270 | Second pressure actuated valve |
| 271 | Second valve frame |
| 272 | Lower cavity |
| 273 | Lower orifice |
| 274 | Upper orifice |
| 275 | Second transverse port |
| 276 | Second valve sphere |
| 277 | Upper cavity |
| 278 | Internal valve seat |
| 279 | Second valve spring |
| 280 | First alternative primary valve assembly |
| 281 | First alternative valve body |
| 282 | First valve frame hole |
| 284 | Longitudinal valve body hole |
| 289 | Main valve partial bore |
| 291 | Alternative main valve pin |
| 299 | Chamber porting valve hole |
| 360 | First pressure actuated flapper valve |
| 361 | First flapper valve tube |
| 362 | First tube cavity |
| 363 | First valve screw |
| 364 | First valve spacer |
| 366 | First valve flapper |
| 368 | First flapper valve seat |
| 370 | Second pressure actuated flapper valve |
| 371 | Second flapper valve tube |
| 372 | Second tube cavity |
| 373 | Second valve screw |
| 374 | Second valve spacer |
| 376 | Second valve flapper |
| 378 | Second flapper valve seat |
| 380 | Second alternative primary valve assembly |
| 381 | Second alternative valve body |
| 383 | Second valve tube hole |
| 385 | Second valve vertical partial bore |
| 389 | Second valve lower chamber hole |

DESCRIPTION OF THE PREFERRED EMBODIMENT

Referring to FIG. 1, which shows the gun cocked and ready to fire, the gun continues many of the aspects of a conventional gun, having a frame 20, a barrel 30, a projectile magazine (not shown) connecting to a projectile feed assembly 37, and a trigger mechanism (not shown) with a trigger sear 47 which penetrates frame 20 through a sear access slot 25.

The gun further comprises within frame 20 an upper chamber 21, and a lower chamber 22, connected by an interchamber hole 23. In upper chamber 21 is a bolt 100 and an upper chamber plug 29. Forward in lower chamber 22 is a compressed gas reservoir 35, sealed at the forward end by a reservoir plug 31 with an O-ring seal 32, and sealed at the rearward end by a primary valve assembly 80 with an O-ring seal 82. A reservoir port 36 in the wall of reservoir 35 provides for attachment of a conventional source of compressed gas (not shown). Rearward of primary valve assembly 80, in lower chamber 22, is a striker chamber 46 bounded at its rearward end by a striker 50.

Figure 2:
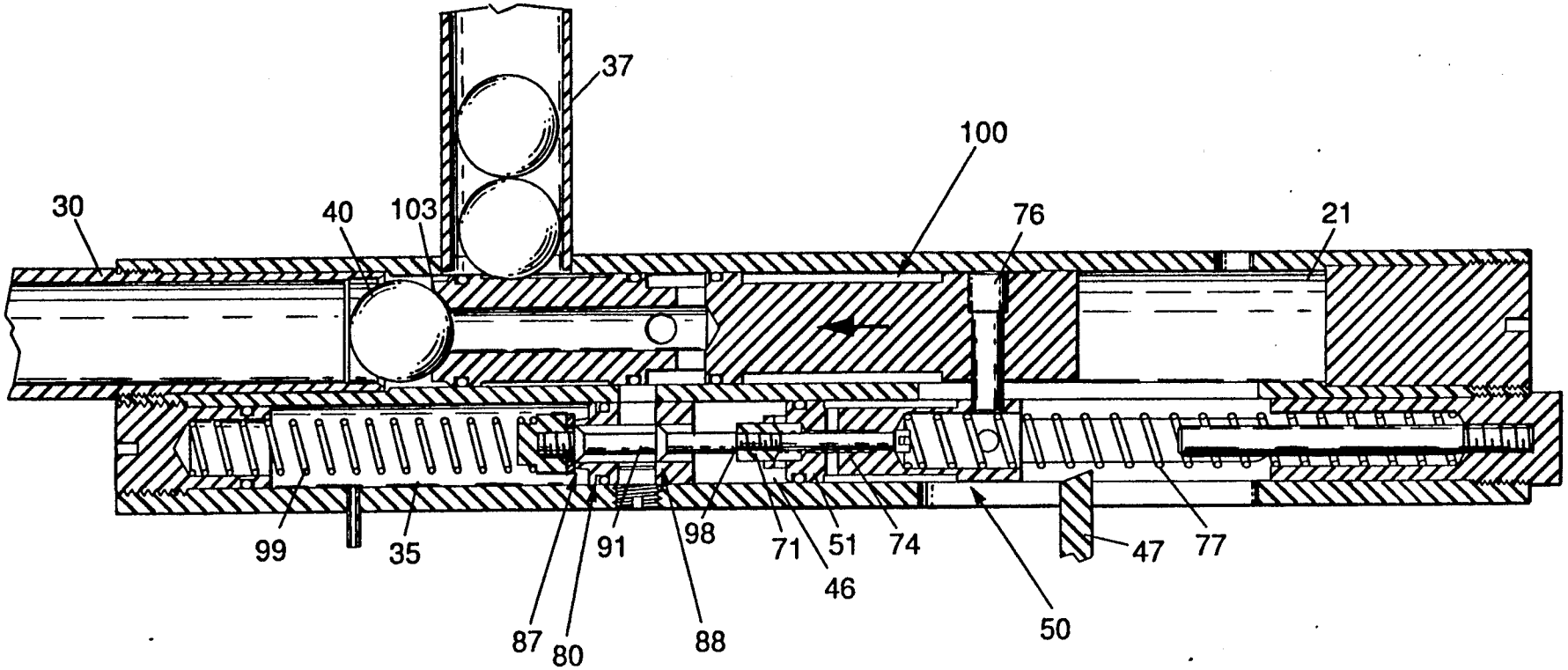
FIG. 2 shows a side cross-sectional view of the gun after the striker has been released by the sear and has moved forward to the point where the striker poppet valve plug has initially contacted the main valve pin.
Figure 3:
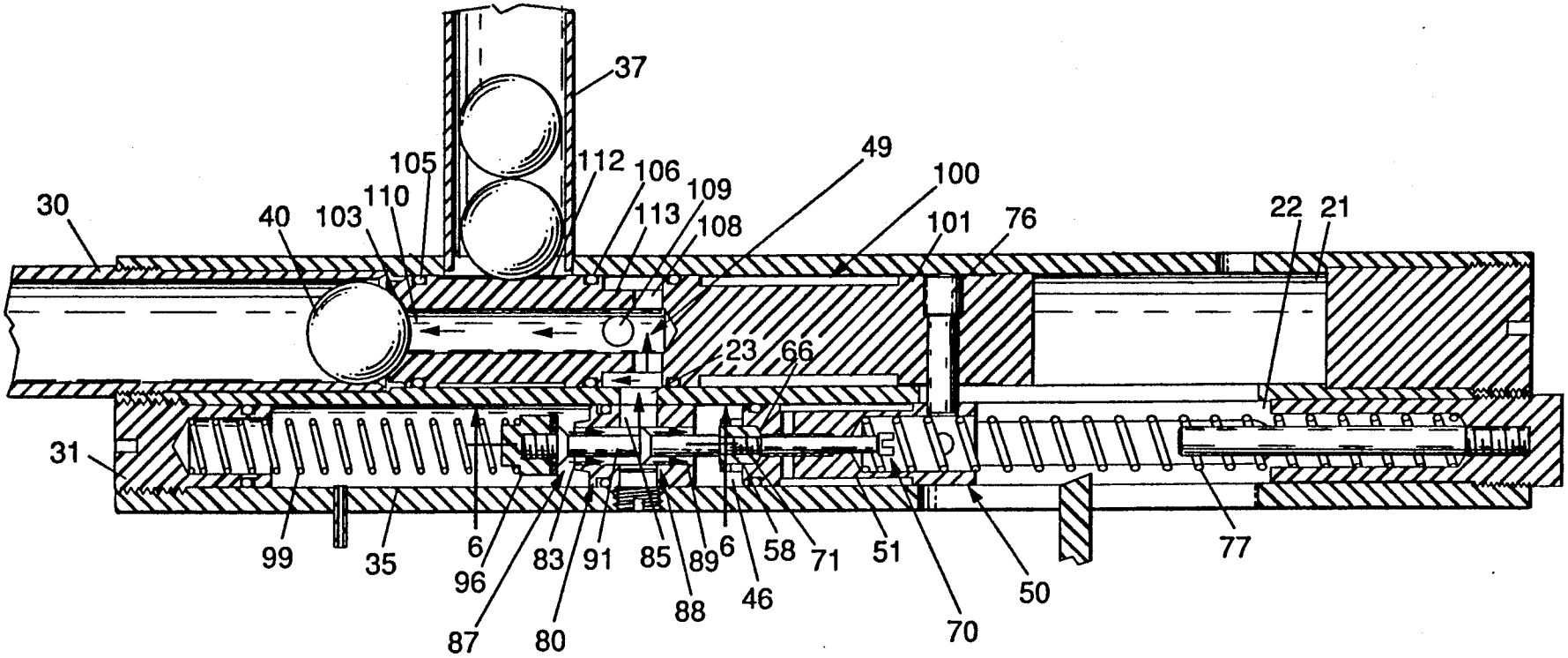
FIG. 3 shows a side cross-sectional view of the gun with the striker nominally at its most forward position, with the striker poppet valve forced closed, and the primary valve assembly forced open by the impact of the striker.
Figure 4:
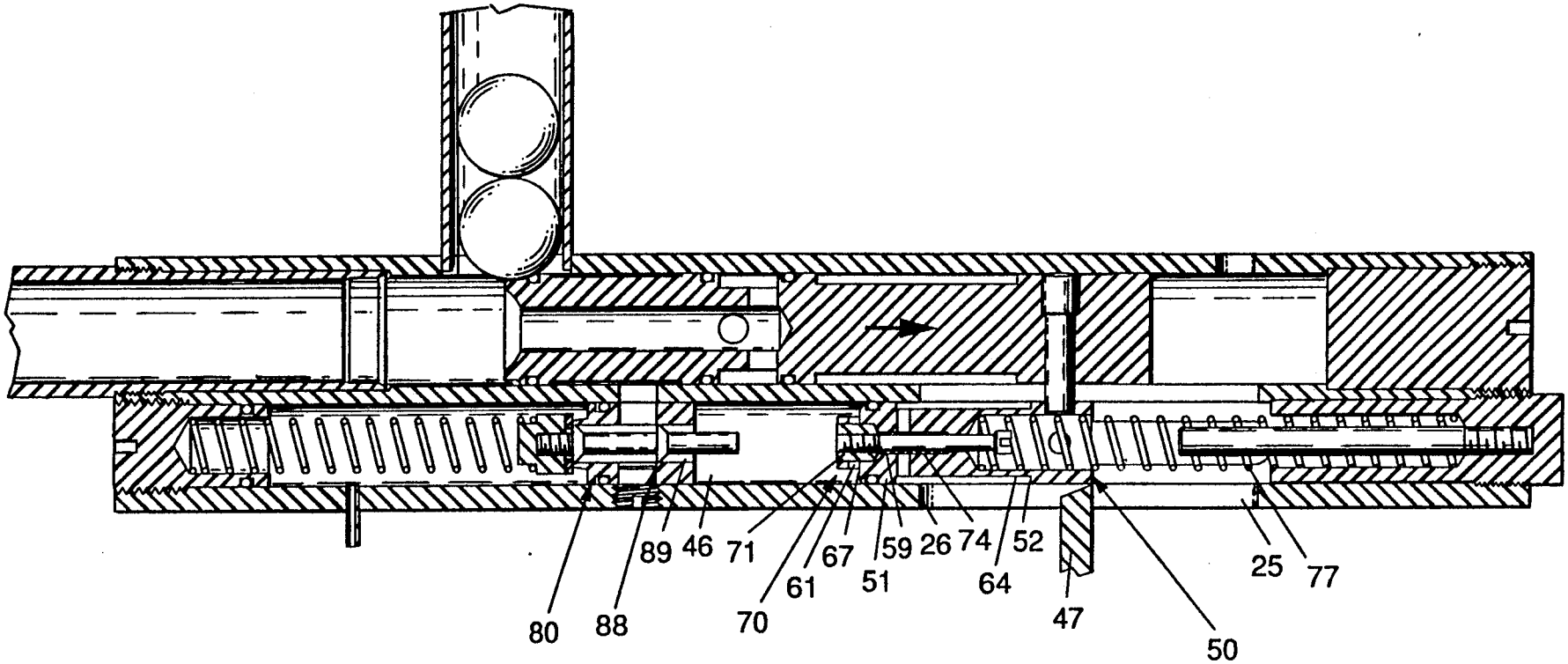
FIG. 4 shows a side cross-sectional view of the gun part way through the recocking process, with the striker moving rearward and the striker poppet valve held closed due to the pressure of the gas charge in the striker chamber.

Striker 50 is slidable within and effectively seals striker chamber 46. When the gun is ready to fire, as shown in FIG. 1, striker 50 is held in a cocked position against the forward urging of a compressed striker power spring 77 by sear 47. Upon firing, striker 50 is urged forward by spring 77, as shown in FIG. 2. Striker 50 continues forward to a position of full impact on valve assembly 80, thereby opening valve assembly 80, as shown in FIG. 3, to release a charge of compressed gas from reservoir 35 into striker chamber 46. Striker 50 is then urged back toward the cocked position as shown in FIG. 4 by the charge of compressed gas in striker chamber 46.

Figure 5:
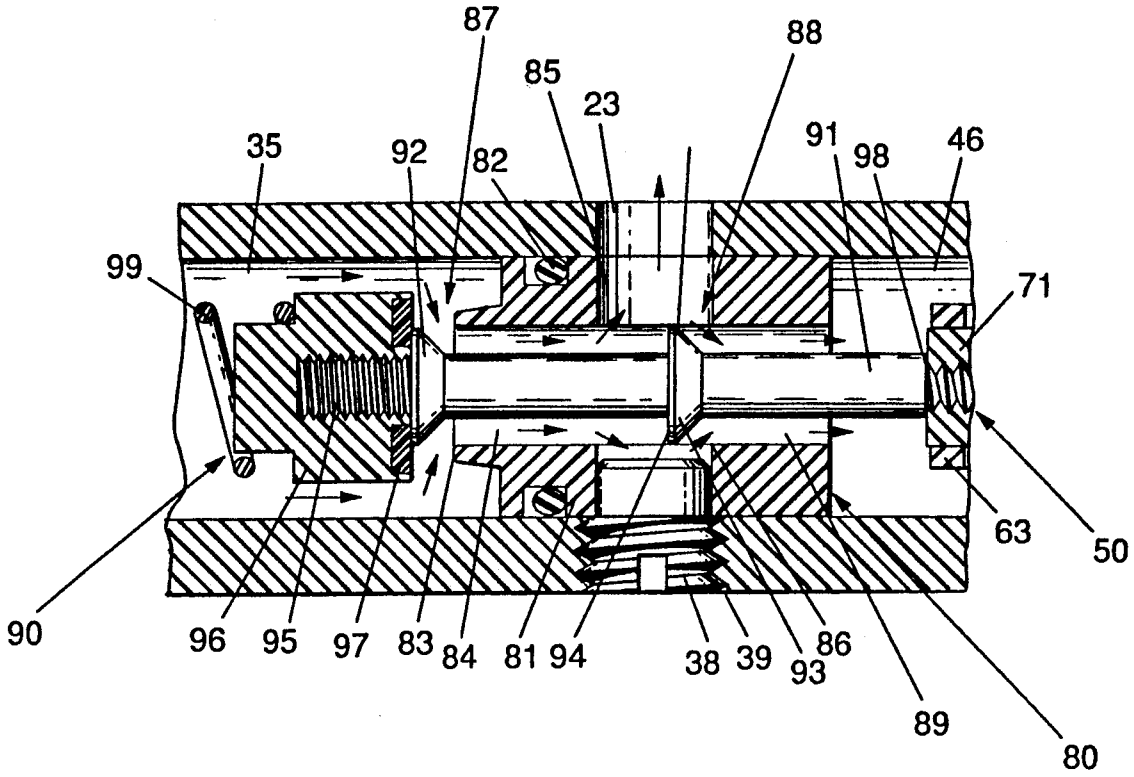
FIG. 5 shows an enlarged side cross-sectional view of the primary valve assembly in the same operating state as in FIG. 3.
Figure 6:
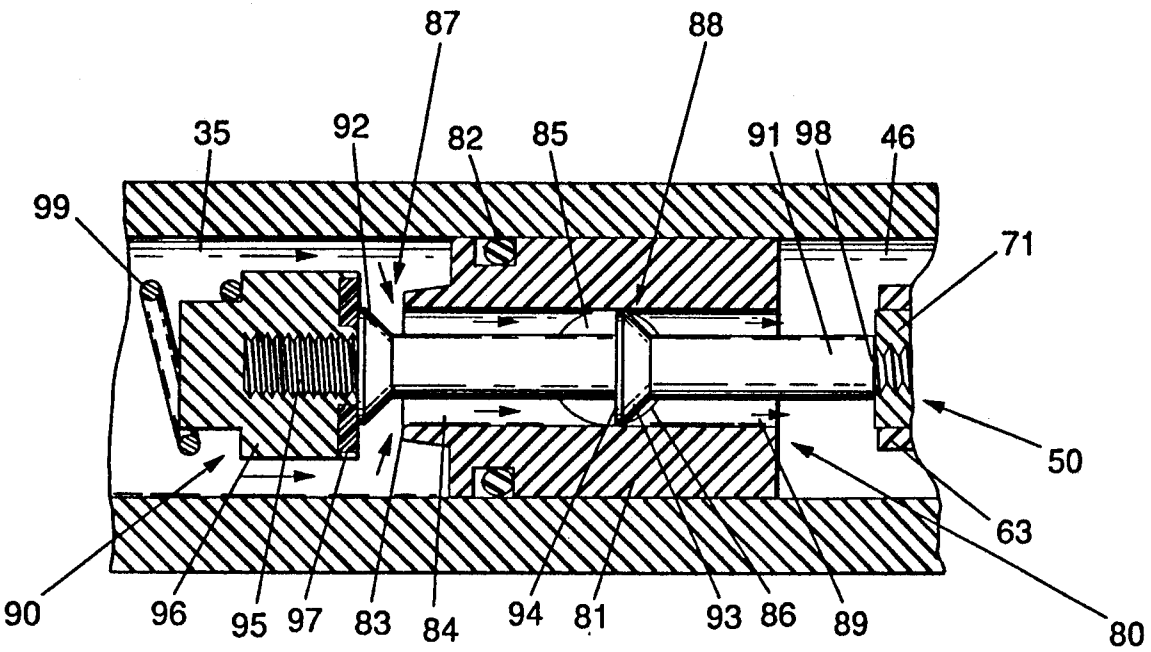
FIG. 6 shows an enlarged bottom cross-sectional view of the primary valve assembly in the same operating state as in FIGS. 3 and 5.

Turning now to a more detailed description of the elements of the gun, FIGS. 3, 5 and 6 show valve assembly 80 in the same open state, with small arrows illustrating the flow of compressed gas. Referring to FIG. 5, valve assembly 80 incorporates a valve body 81 and a main poppet valve 90. On valve body 81 is a main valve seat 83 in fluid communication with reservoir 35. Within valve body 81, parallel to striker chamber 46, is a longitudinal valve body hole 84 extending between main valve seat 83 and striker chamber 46. Transversely penetrating valve body 81 is a vertical valve body hole 85 which orthogonally forms a valve hole intersection 86 with longitudinal hole 84.

Valve body 81 is mounted with vertical hole 85 in alignment with interchamber hole 23. Valve body 81 is held in alignment by a threaded valve body locking pin 38 screwed into a threaded valve body locking pin hole 39 opposite interchamber hole 23 and penetrating into vertical hole 85.

Main poppet valve 90 incorporates a main valve pin 91, which is smaller than and longitudinally translatable in longitudinal valve body hole 84, and which extends rearward into striker chamber 46 to terminate in a pin impact face 98. Forward on valve pin 91 is a threaded end portion 95, onto which fits a correspondingly threaded cup seal 96 containing a resilient sealing element 97. Adjacent to installed cup seal 96 and concentric on valve pin 91 is a main conical element 92. Cup seal 96 is urged toward valve seat 83 by a primary valve spring 99, which extends from reservoir plug 31 to cup seal 96 as shown in FIG. 3, and by the compressed gas in reservoir 35.

Referring to FIG. 5, cup seal 96, main conical element 92, and valve seat 83 form a normally closed main valve 87 of conventional design, which regulates all release of gas from reservoir 35. The sealing action of main valve 87 is achieved by resilient sealing element 97 of cup seal 96 pressing against main valve seat 83. Main conical element 92 serves, when main valve 87 is partially open, to moderate the flow of compressed gas from reservoir 35 into longitudinal hole 84, and when main valve 87 is closing, to help maintain the concentricity of cup seal 96 relative to valve seat 83.

O-ring seal 32 shown in FIG. 1, and O-ring seal 82 and cup seal 96 shown in FIG. 5, are the only seals within the gun which are required to restrain gas at the full pressure of the compressed gas source. Of these three seals, O-ring seals 32 and 82 are static, and only cup seal 96 involves relative movement of the seal and a mating surface during gun operation.

Referring again to FIG. 5, longitudinal hole 84 provides a secondary channel 89 surrounding valve pin 91 and extending from valve hole intersection 86 to striker chamber 46. Concentric on valve pin 91 is a secondary conical element 93, which tapers rearward from a conical element base 94. Conical element base 94 extends outward in longitudinal hole 84 essentially to valve body 81. Secondary channel 89, with conical element 93 on valve pin 91, forms a low pressure secondary valve 88 which regulates the flow of gas through secondary channel 89.

When valve pin 91 is in the normal closed position, as shown in FIG. 1, conical element base 94 is immediately rearward of vertical hole 85, closing secondary valve 88 and effectively sealing secondary channel 89. When valve pin 91 moves forward, as shown in FIG. 5, main valve 87 opens and conical element base 94 moves into hole intersection 86, opening secondary valve 88.

Referring to the arrows illustrating gas flow in FIG. 5, the flow is from reservoir 35, through longitudinal hole 84, to hole intersection 86. A portion of the gas then flows upward within vertical hole 85 to interchamber hole 23, while another portion flows through secondary valve 88 and into striker chamber 46.

As main valve 87 is opening, the rate at which it opens varies as the size of the opening increases. The rate at which secondary valve 88 opens also varies as the size of the opening increases. As can be seen more clearly in FIG. 6, secondary valve 88 differs in structure from main valve 87, so that there is a difference in the manner in which the rate of opening varies for the two valves. As the two valves open, this difference results in variation in the relative size of the openings provided for gas flow by the two valves, and hence variation in the proportion of gas released by main valve 87 which flows through secondary valve 88 and into striker chamber 46.

Over a typical range of gun operating conditions, as the valves open further the rate of opening generally increases for secondary valve 88, and decreases for main valve 87, causing the ratio of the opening provided by secondary valve 88, relative to the opening provided by main valve 87, to increase with increased opening of the two valves. As a result, when lower source gas pressure allows the two valves to open farther, a greater proportion of the gas released by main valve 87 can flow through secondary valve 88 and into striker chamber 46. This increase in the amount of gas within striker chamber 46 provides increased energy to urge striker 50 back to the cocked position, thereby helping to compensate for the lower source gas pressure. By changing the shape of the elements of secondary valve 88, or of main valve 87, those skilled in the art can modify the variation in the relative opening of the two valves and thereby adjust the compensation achieved.

Figure 7:
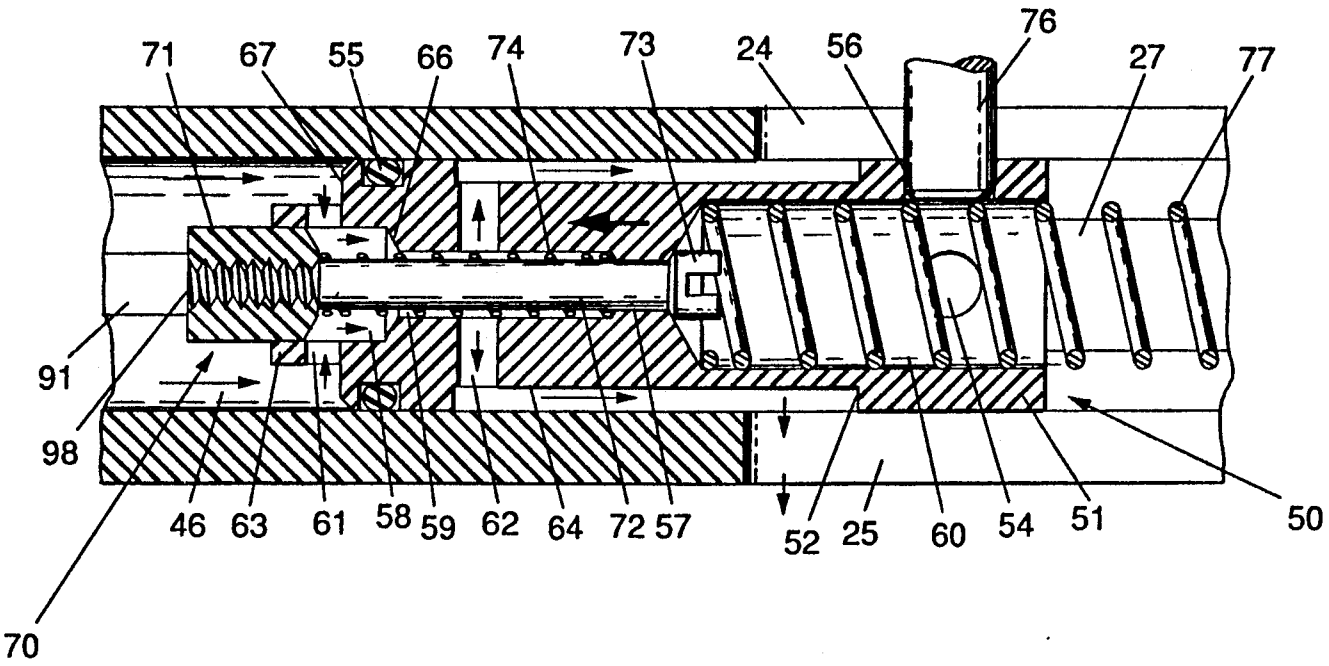
FIG. 7 shows an enlarged side cross-sectional view of the striker assembly in the same operating state as in FIG. 2.

Turning to striker 50, as shown in FIG. 7, it is principally a valved piston in a cylinder, having a striker body 51 fitting slidably in and sealing striker chamber 46 with an O-ring seal 55 rearward of a forward full diameter face 67. Coaxial in striker body 51 are a striker hole 57, a first partial bore 58 terminated rearward in a rear bore face 66, a second partial bore 59, a third partial bore 60, a striker poppet valve 70 consisting of a poppet valve screw 72 threaded into a poppet valve plug 71, and a poppet valve spring 74 loosely surrounding poppet valve screw 72 and fitting loosely in second bore 59.

Screw 72 is slidable in striker body hole 57. Plug 71 is slidable in and effectively seals first bore 58. Rearward translation of plug 71 relative to striker body 51 is limited by rear bore face 66 of first bore 58. Spring 74 urges screw 72 and attached plug 71 forward to the limit imposed by a poppet valve screw head 73.

Striker body 51 has a forward reduced diameter portion 63 forward of forward full diameter face 67, and an intermediate reduced diameter portion 64 rearward of O-ring seal 55. As shown in FIG. 1, the rearward boundary of intermediate reduced diameter portion 64 provides a sear notch 52 for insertion of sear 47, which penetrates lower chamber 22 through sear access slot 25. Striker 50 is urged forward by striker power spring 77 inserted into third partial bore 60 and extending rearward to a lower rear chamber plug 68. Trigger sear 47 serves, when inserted in sear notch 52, to restrain striker 50 in the cocked position against the forward urging of spring 77.

As FIG. 7 shows, penetrating the rearward extent of forward reduced diameter portion 63 of striker body 51 and intersecting first bore 58 is a forward transverse port 61. Penetrating intermediate reduced diameter portion 64 of striker body 51 and intersecting second partial bore 59 is an intermediate transverse port 62.

When plug 71 is forward in striker body 51 as shown in FIG. 7, poppet valve 70 is open, and gas can escape from striker chamber 46 as shown by the small arrows, flowing in succession through forward port 61, first bore 58, second bore 59, and intermediate port 62, past intermediate reduced diameter portion 64, and through access slot 25. When plug 71 is rearward in striker body 51, as shown in FIGS. 3 and 4, so that poppet valve 70 is closed, this flow is blocked. Referring to FIG. 7, when plug 71 is rearward, it blocks gas from passing from forward port 61 to second bore 59, substantially preventing gas from escaping striker chamber 46.

Actuation of valve 70 is in part due to contact, and in part due to spring urging. Spring 74 constantly urges poppet valve 70 toward the open state shown in FIG. 7. During firing of the gun, valve 70 closes as a result of plug 71 contacting main valve pin 91. FIGS. 2 and 7 show plug 71 first coming in contact with pin face 98 of main valve pin 91, and FIG. 3 shows the situation a short time later when valve 70 has closed due to continued forward motion of striker body 51.

Actuation of valve 70 is also due in part to gas pressure. When plug 71 is rearward in striker body 51, as shown in FIG. 4, forward port 61 is blocked and second partial bore 59 is essentially at ambient pressure. With second partial bore 59 at ambient pressure, a charge of compressed gas in striker chamber 46 acts to urge plug 71 rearward. Spring 74 is selected so as not to exert sufficient force to translate plug 71 forward within striker body 51 against this urging of the compressed gas in striker chamber 46. When striker 50 is in the cocked position, as in FIG. 1, forward full diameter face 67 of striker body 51 is rearward of a forward end 26 of access slot 25, permitting compressed gas to exhaust from striker chamber 46, thereby allowing striker chamber 46 to return to ambient pressure. Spring 74 is further selected to exert sufficient force to translate plug 71 forward within striker body 51 when striker chamber 46 is substantially at ambient pressure.

Referring to FIG. 1, transverse in striker body 51 is a threaded striker handle attachment hole 54 for insertion of a correspondingly threaded striker handle (not shown) which permits manual movement of striker 50. The striker handle is translatable within a striker handle slot 27 which is parallel to the axis of lower chamber 22, and which extends longitudinally a sufficient distance so as not to limit the forward or rearward movement of striker 50 during operation of the gun.

Concentric on lower rear chamber plug 68 and internal to spring 77 is a lower chamber pin 69. Pin 69 serves in part to reduce kinking of spring 77, and in part to unjam poppet valve 70 if this should be required. Pin 69 extends forward in lower chamber 22 a distance such that, if foreign material such as dirt or sand has caused poppet valve 70 to temporarily jam in the rearward closed position, striker 50 can be manually propelled rearward by use of the striker handle to a position of contact between pin 69 and screw head 73, at which point further rearward manual movement will cause poppet valve 70 to reset to the forward open position.

Bolt 100, shown in FIG. 1, incorporates a bolt body 101 fitting slidably in and sealing upper chamber 21 with O-ring seals 105, 106 and 107. Bolt body 101 has a forward face 103 shaped to conform approximately to the shape of the projectiles which the gun is intended to fire. Intermediate to seals 105 and 106 is a first reduced diameter portion 112 of bolt body 101. Intermediate to seals 106 and 107 is a second reduced diameter portion 113 of bolt body 101, which is intersected by a vertical transverse bore 108 and a horizontal transverse bore 109. Intersecting vertical bore 108 and horizontal bore 109, and extending forward concentric in bolt body 101 to forward face 103, is a longitudinal partial bore 110.

Rearward in bolt body 101 is a bolt connecting pin hole 111 containing a connecting pin 76 which extends downward, through a connecting pin slot 24 between upper chamber 21 and lower chamber 22, and into a striker connecting pin hole 56 in striker body 51. Connecting pin 76 constrains bolt 100 and striker 50 to move in concert within their respective chambers. A connecting pin access hole 28, in the upper circumference of upper chamber 21, enables placement and removal of connecting pin 76 after striker 50 and bolt 100 have been manually translated to align their respective connecting pin holes 56 and 111 with connecting pin access hole 28.

Figure 8:
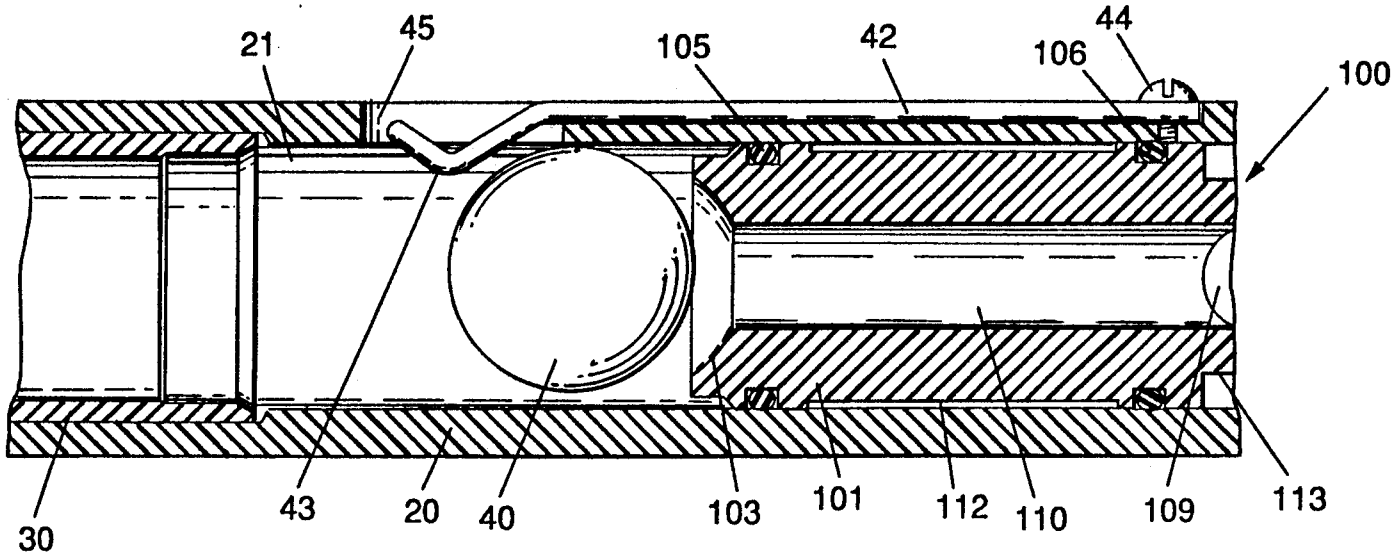
FIG. 8 shows a top cross-sectional view through the upper chamber of the gun in the same operating state as FIG. 1, with a projectile held within the gun between the bolt and the projectile retention spring tip.

Referring to FIG. 8, which shows a top view of the gun, a projectile 40, having entered upper chamber 21 via projectile feed assembly 37 shown in FIG. 1, is constrained in position at forward face 103 of bolt body 101 by a spring tip 43 of a projectile retention spring 42. Projectile retention spring 42 is attached to the exterior of frame 20 by a spring screw 44, and enters upper chamber 21 through a spring slot 45 cut into the wall of chamber 21. As bolt 100 moves forward in concert with striker 50 during firing, forward face 103 is in contact with projectile 40 as shown in FIG. 2, and pushes projectile 40 forward past spring tip 43 and into barrel 30 as shown in FIG. 3. In this forward position, O-ring seals 105 and 106 of bolt 100 seal projectile feed assembly 37 from upper chamber 21.

Referring to FIG. 3 for the elements of bolt 100, and to FIG. 5 for the elements of primary valve assembly 80, second reduced diameter portion 113 is located on bolt body 101 such that, when striker 50 is in a position of impact on primary valve assembly 80, second reduced diameter portion 113 is in effective alignment with interchamber hole 23. This alignment completes a main channel 49, which begins at main valve seat 83 and which includes in succession: the portion of longitudinal valve body hole 84 between valve seat 83 and valve hole intersection 86; hole intersection 86; the portion of vertical valve body hole 85 between hole intersection 86 and interchamber hole 23; interchamber hole 23; the opening formed by intermediate reduced body diameter portion 113 within upper chamber 22; vertical and horizontal bores 108 and 109; and longitudinal bore 110. Main channel 49 receives gas from reservoir 35 when main valve 87 is open, and has outputs for gas at forward face 103 of bolt body 101, thereby providing gas to the rear surface of projectile 40 which is being expelled from the gun, and to secondary channel 89 when secondary valve 88 is open.

OPERATION OF THE INVENTION

With the elements of the gun described, the manner of operation will be clarified. FIG. 1 shows the gun ready to fire. Main poppet valve 90 of primary valve assembly 80 is urged rearward by the pressure of the gas in reservoir 35, and by the urging of primary valve spring 99, so that main valve 87 is held closed, preventing the escape of compressed gas from reservoir 35. Striker 50 is restrained in the cocked position against the forward urging of compressed striker power spring 77 by trigger sear 47 inserted in sear notch 52. Striker poppet valve plug 71 is in the forward position relative to striker body 51. Projectile 40 is held in place for firing immediately forward of bolt assembly 100 by retention spring tip 43, as shown in FIG. 8.

Upon operator actuation of the trigger mechanism (not shown), trigger sear 47 translates downward, releasing striker 50 to move forward in response to the urging of spring 77 as shown in FIG. 2. As striker 50 moves forward, the forward position of plug 71 in striker body 51 results in an open path from forward transverse port 61 to second bore 59, thereby allowing gas to escape from striker chamber 46 as described previously. This venting of gas from striker chamber 46 improves efficiency by reducing an impediment to the forward motion of striker 50, thereby allowing more of the energy stored in compressed spring 77 to contribute to the impact of striker 50 on main valve pin 91 of primary valve assembly 80.

The first portion of striker 50 to contact primary valve assembly 80 is plug 71. The inertia of moving plug 71, in combination with the urging of relatively weak poppet valve spring 74, is overcome by the combined force of primary valve spring 99 and the pressure of the compressed gas in reservoir 35 urging valve pin 91 rearward, so that plug 71 stops moving momentarily, until striker body 51 moves forward to the point where plug 71 makes contact with rear bore face 66 of first partial bore 58 as shown in FIG. 3. The inertia of moving striker body 51, in combination with the urging of striker power spring 77, is momentarily sufficient to overcome the combined force of primary valve spring 99 and the pressure of the compressed gas in reservoir 35 urging valve pin 91 rearward, so that striker 50 continues forward, moving valve pin 91 forward, opening main valve 87 and secondary valve 88.

Referring again to the sequence shown in FIGS. 1 to 3, connecting pin 76 constrains bolt 100 to move forward with striker 50. The forward motion of bolt 100 pushes projectile 40 forward into barrel 30; seals projectile feed assembly 37 against escape of the compressed gas introduced into upper chamber 21 to expel projectile 40; and brings second reduced diameter portion 113 of bolt 100 into approximate alignment with first interchamber hole 23, temporarily completing main channel 49 described previously.

With channel 49 completed, a portion of the gas released by main valve 87 passes through channel 49, as shown in FIG. 3, to expel projectile 40 forward through barrel 30. With secondary valve 88 open, another portion of the released gas passes through secondary channel 89 as shown in FIG. 5 and into striker chamber 46, where it urges striker 50 rearward. Main poppet valve 90, which is urged rearward by primary valve spring 99, by the compressed gas in reservoir 35 acting on cup seal 96, by drag due to compressed gas flowing rearward alongside main valve pin 91, and by force exerted by compressed gas on conical element base 94, also urges striker 50 rearward so long as the contact between main poppet valve 90 and striker 50 continues. With rearward movement of poppet valve 90, secondary valve 88 closes, preventing escape via secondary channel 89 of the charge of compressed gas now in striker chamber 46.

Referring to FIG. 6, variation in the relative size of the opening provided by main valve 87 and secondary valve 88 helps to compensate for differences in source gas pressure associated with normal changes in propellent fluid temperature. Lower gas pressure is less effective in urging poppet valve 90 rearward, allowing main and secondary valves 87 and 88 to open farther when gas pressure is lower. As the two valves open farther, the ratio of the opening provided by secondary valve 88, relative to the opening provided by main valve 87, increases as discussed previously. This higher ratio increases the proportion of the gas released by main valve 87 which passes through secondary valve 88 and into striker chamber 46, thereby helping to compensate for the lower gas pressure, which in turn achieves successful recocking at a lower gas pressure than would otherwise be possible.

As striker 50 begins to move rearward, plug 71 is rearward in striker body 51, as shown in FIG. 3, blocking the charge of compressed gas in striker chamber 46 from reaching second bore 59, and thereby escaping, as shown in FIG. 7, to a region outside of striker chamber 46. Referring to FIG. 4, as striker 50 continues to move rearward in response to the urging of the charge of compressed gas, plug 71 remains rearward in striker body 50, also because of the urging of the charge of compressed gas. In addition, secondary valve 88 is closed, preventing the charge of compressed gas from escaping striker chamber 46 through secondary channel 89.

As striker body 51 begins to move across trigger sear 47, sear 47 is depressed. As sear notch 52 in striker body 51 passes rearward of sear 47, sear 47 rises to contact intermediate reduced diameter portion 64 of striker body 51. Also, forward full diameter face 67 of striker body 51 passes rearward of forward end 26 of sear access slot 25, permitting the charge of compressed gas to exhaust from striker chamber 46. Finally, striker body 51 moves forward in response to the urging of striker power spring 77, stopping in the cocked position shown in FIG. 1 as sear notch 52 contacts sear 47. With striker 50 in the cocked position, bolt forward face 103 is rearward of projectile feed assembly 37, permitting another projectile to descend under the urging of gravity into upper chamber 21, and the gun is again ready to fire.

As can be understood from the foregoing description, striker 50 incorporates valved porting of striker chamber 46, which is open to permit gas to escape to a region outside of striker chamber 46 as striker 50 moves forward to impact on primary valve assembly 80, and which subsequently closes to seal striker chamber 46 against premature loss of the charge of compressed gas acting to urge striker 50 to the cocked position. Secondary valve 88 provides unidirectional valving, by which a charge of compressed gas introduced into striker chamber 46 via secondary channel 89 is subsequently prevented from escaping striker chamber 46 back along that same route. Both the valved porting, and the unidirectional action of secondary valve 88, provide the advantage of conserving energy provided by the gas charge released into striker chamber 46 for recocking the gun. Furthermore, secondary valve 88 provides a rate of opening which varies with the size of the opening differently than for main valve 87. The resulting variation in the relative opening provided by the two valves permits one skilled in the art to compensate for variations in source gas pressure, advantageously permitting recocking to be achieved over a wider range of source gas pressures. Finally, maintenance is minimized by main valve 88 being the single high pressure valve in the gun.

ALTERNATIVE EMBODIMENTS

Figure 9:
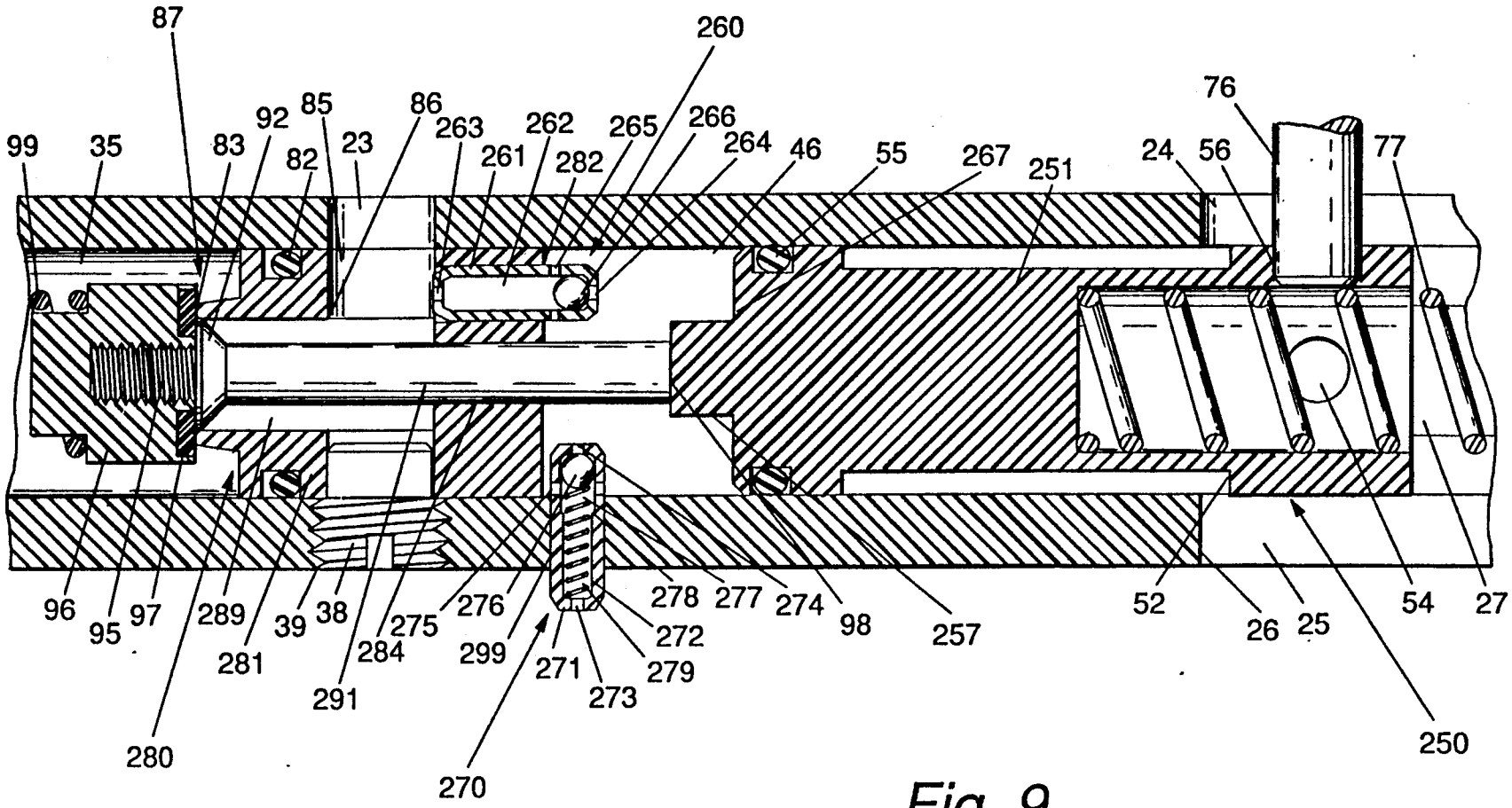
FIG. 9 shows a side cross-sectional view of a first alternative embodiment incorporating two pressure-sensitive valves with spherical valving elements.
Figure 10:
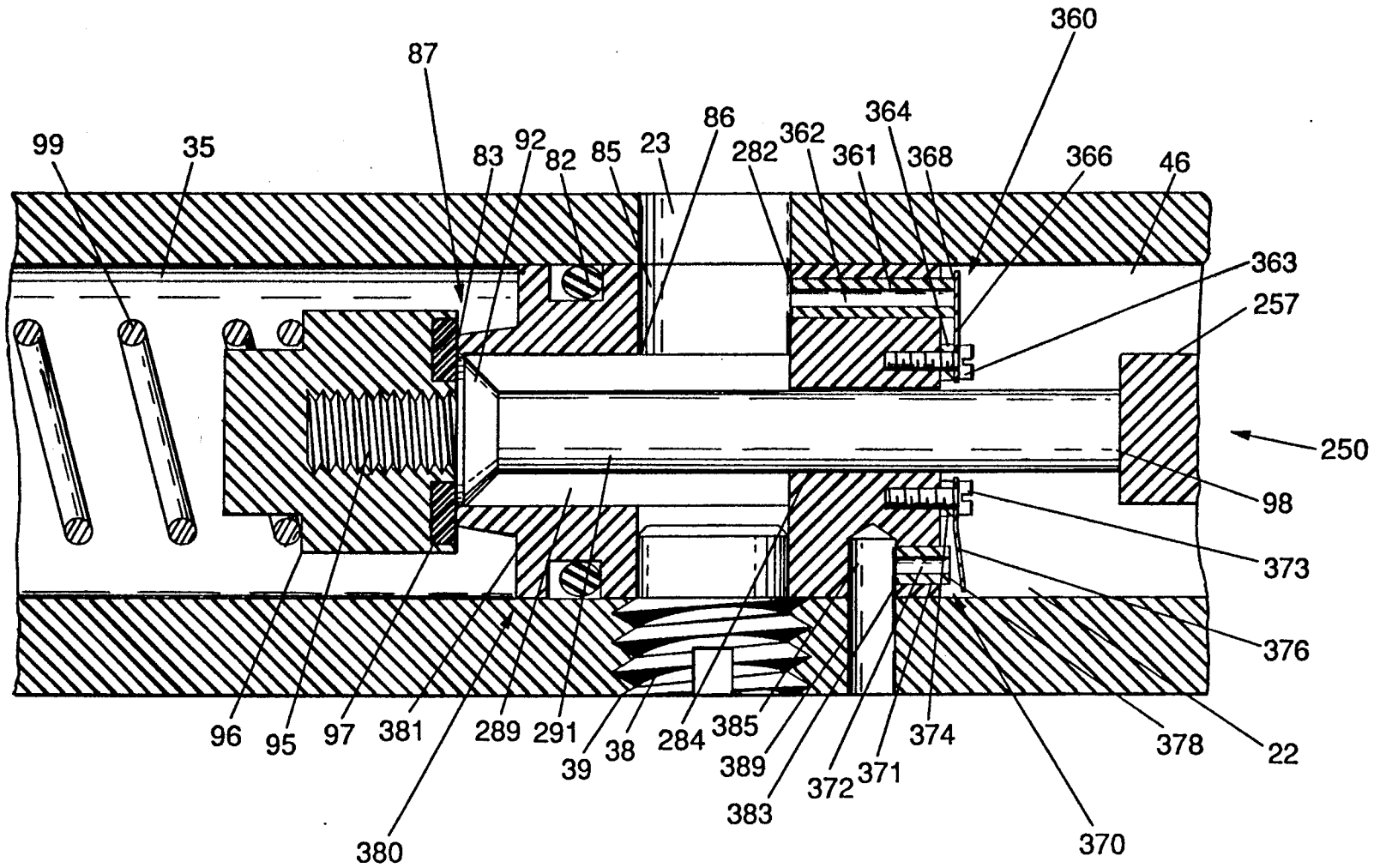
FIG. 10 shows a side cross-sectional view of a second alternative embodiment incorporating two pressure-sensitive valves, each with a flexible flapper to seal a valve seat which is internal to the striker chamber.

Alternative embodiments of the invention are shown in FIGS. 9 and 10 and described below. Where elements correspond to those of the preferred embodiment in FIGS. 1 to 8, and perform the same function, they are identified by the same number. Elements which are different from the elements of the preferred embodiment have been identified by numbers of 250 or greater.

In a first alternative embodiment, as shown in FIG. 9, a first alternative primary valve assembly 280 is located intermediate reservoir 35 and striker chamber 46. Valve assembly 280 incorporates a first alternative valve body 281 with O-ring seal 82, and with main valve seat 83 in fluid communication with compressed gas reservoir 35. Within valve body 281, parallel to striker chamber 46 and extending rearward from valve seat 83, is a main valve partial bore 289. Coaxial with and extending rearward from partial bore 289 to striker chamber 46 is a longitudinal valve body hole 284. Transversely penetrating valve body 281 is vertical valve body hole 85 which intersects partial bore 289. An alternative main valve pin 291 is slidable in and effectively seals valve body hole 284. Valve pin 291 terminates rearward in pin impact face 98 within striker chamber 46, and terminates forward in threaded end portion 95 onto which fits correspondingly threaded cup seal 96 which contains resilient sealing element 97. Adjacent to installed cup seal 96, and concentric on valve pin 291, is main conical element 92, which together with valve seat 83 and cup seal 96, continues to form main valve 87 as in the preferred embodiment.

Within striker chamber 46 is a solid striker 250 incorporating a solid striker body 251 fitting slidably in and sealing striker chamber 46 with O-ring seal 55. Forward on striker body 251 is a forward projection 257 on a solid striker forward full diameter face 267. During firing of the gun striker 250 moves forward, in response to the urging of striker power spring 77, to impact projection 257 upon pin face 98, thereby moving valve pin 291 and attached cup seal 96 away from striker chamber 46, which opens main valve 87 to release compressed gas from reservoir 35 into partial bore 289, and from there to vertical hole 85.

Valve assembly 280 also includes a first pressure actuated valve 260 incorporating a first valve frame 261 fitting in a corresponding first valve frame hole 282 in valve body 281. Within valve frame 261 is an elongated frame cavity 262 with a forward orifice 263 of constricted diameter between cavity 262 and vertical valve body hole 85, and with a first transverse port 265 and a rear orifice 264 of constricted diameter between cavity 262 and striker chamber 46. Captive within cavity 262 and free to move between forward orifice 263 and rear orifice 264 is a first valve sphere 266 which is sealably engagable against forward orifice 263.

When compressed gas is released from reservoir 35 into vertical hole 85 during firing of the gun, some of the gas passes through forward orifice 263 and into cavity 262, where it acts initially to urge sphere 266 to move to a position of contact with rear orifice 264. With sphere 266 in this position, the gas can flow through transverse port 265 and into striker chamber 46.

As striker 250 subsequently moves rearward allowing cup seal 96 to contact valve seat 83 and shut off the release of compressed gas, the pressure begins to drop in both vertical hole 85 and striker chamber 46. In part because the projectile being expelled from the gun offers less resistance to movement than striker 250, the pressure drops faster in vertical hole 85 than in striker chamber 46. As the pressure in vertical hole 85 drops below the pressure in striker chamber 46, gas begins to flow from striker chamber 46 back toward vertical hole 85, passing in succession through transverse port 265, cavity 262, and forward orifice 263. The relative sizes of tranverse port 265 and forward orifice 263 are such that the pressure within cavity 262 becomes lower than in striker chamber 46. The higher pressure within striker chamber 46, acting through rear orifice 264 on the rear face of sphere 266, results in a net force which urges sphere 266 forward to a position of contact with forward orifice 263, which it seals, effectively preventing further loss of the gas charge from striker chamber 46.

The first alternative embodiment also incorporates a second pressure actuated valve 270. Valve 270 incorporates a second valve frame 271 extending into striker chamber 46 and fitting in a corresponding chamber porting valve hole 299 in the circumference of striker chamber 46 forward of the forward-most position of forward full diameter face 267. Valve 270 incorporates within valve frame 271 a lower cavity 272 terminated upward in an internal valve seat 278 and terminated downward in a lower orifice 273 of constricted diameter external to striker chamber 46; an upper cavity 277 terminated upward in an upper orifice 274 of constricted diameter in fluid communication with striker chamber 46, and terminated downward in internal valve seat 278; and a second transverse port 275 connecting upper internal cavity 277 with striker chamber 46.

Captive within upper cavity 277 and free to move between upper orifice 274 and valve seat 278 is a second valve sphere 276 sealably engagable on valve seat 278. A second valve spring 279, restrained at the lower end by the constriction of lower orifice 273, urges second sphere 276 upward to a normal position against upper orifice 274. When second sphere 276 is in the normal position against upper orifice 274, valve 270 is open and gas can escape from striker chamber 46 by flowing successively through transverse port 275, upper cavity 277, lower cavity 272, and lower orifice 273.

When gas pressure is higher in striker chamber 46 than in upper cavity 277, the higher pressure acting through upper orifice 274 on the upper face of sphere 276 urges sphere 276 to move downward against the counteracting urging of spring 279. The characteristics of the elements of valve 270 are selected so that the upward of spring 279 overcomes the downward urging due to the increased pressure of the gas in striker chamber 46 as striker 250 moves forward during firing from the cocked position to a position of impact on valve assembly 280, thereby maintaining valve 270 in the open state and permitting gas in striker chamber 46 to vent through valve 270. The characteristics of the elements of valve 270 are also selected so that the much greater downward urging resulting from the much greater pressure of the charge of compressed gas released into striker chamber 46 by the opening of valve assembly 280 is sufficient to overcome the upward urging of spring 279, thereby forcing sphere 276 downward into sealing engagement with valve seat 278, closing valve 270 and preventing the escape of the charge of compressed gas from striker chamber 46.

As can be seen from the foregoing description, valve 260 provides unidirectional secondary valving by which a charge of compressed gas is introduced into striker chamber 46 from vertical hole 85, and is subsequently prevented from escaping from striker chamber 46 back to vertical valve body hole 85. As can also be seen, valve 270 provides valved porting of striker chamber 46, permitting gas to escape as striker 250 moves forward to impact on primary valve 280, and subsequently sealing striker chamber 46 against premature loss of the charge of compressed gas acting to urge striker 250 to the cocked position.

In a second alternative embodiment, as shown in FIG. 10, a second alternative primary valve assembly 380 incorporates a second alternative valve body 381. Many of the elements of valve body 381 are unchanged from valve body 281 of the first alternative embodiment which was shown in FIG. 9, including main valve seat 83, main valve partial bore 289, longitudinal valve body hole 284, vertical valve body hole 85, alternative main valve pin 291 with pin impact face 98, cup seal 96, main conical element 92, and first valve frame hole 282. Also unchanged is solid striker 250, which during firing of the gun moves forward in response to the urging of striker power spring 77, shown in FIG. 9, to impact upon pin face 98 and move valve pin 291 and attached cup seal 96 away from striker chamber 46, thereby releasing compressed gas from reservoir 35 into partial bore 289 and from there to vertical hole 85.

Valve assembly 380 also includes a first pressure actuated flapper valve 360 incorporating a first flapper valve tube 361 fitting in corresponding first valve frame hole 282. Tube 361 incorporates a first flapper valve seat 368 in fluid communication with striker chamber 46, and a first tube cavity 362 internal to tube 361 and extending from valve seat 368 to vertical hole 85. Mounted rearward on valve body 381 by a first valve screw 363, and held away from valve body 381 by a first valve spacer 364 surrounding screw 363, is a flexible first valve flapper 366 sealingly engaged on valve seat 368.

Valve 360 performs nominally the same function as valve 260 in the first alternative embodiment. When compressed gas is released from reservoir 35 into vertical hole 85 during firing of the gun, some of the gas passes into cavity 362, where it acts initially to urge flapper 366 to flex away from valve seat 368. With flapper 366 away from valve seat 368, the gas can flow through cavity 362 and into striker chamber 46. As striker 250 subsequently moves rearward, and the pressure in vertical hole 85 drops approximately to the pressure in striker chamber 46 as described previously, flapper 366 flexes back into sealing engagement on valve seat 368, effectively preventing loss of the gas charge from striker chamber 46.

Valve assembly 380 also includes a second pressure actuated flapper valve 370 incorporating a second flapper valve tube 371 fitting in a second valve tube hole 383 in valve body 381. Tube 371 incorporates a second flapper valve seat 378 in fluid communication with striker chamber 46, and a second tube cavity 372 internal to tube 371 and extending from valve seat 378 to a second valve vertical partial bore 385 in valve body 381. Partial bore 385 is in fluid communication with a second valve lower chamber hole 389 penetrating the lower circumference of lower chamber 22. Attached rearward on valve body 381 by a second valve screw 373, and held away from valve body 381 by a second valve spacer 374 surrounding screw 373, is a flexible second valve flapper 376 sealably engagable on valve seat 378.

The normal position of flapper 376 is a small distance away from valve seat 378, as shown in FIG. 10, so that valve 370 is open and gas can escape from striker chamber 46 by flowing successively through valve seat 378, cavity 372, vertical bore 385 and lower chamber hole 389. When gas pressure is higher in striker chamber 46 than in cavity 372, so that gas is flowing out of striker chamber 46 past flapper 376, the pressure of the gas, plus the drag exerted by the flowing gas on flapper 376, act to urge flapper 376 to move toward a position of sealing engagement on valve seat 378. The characteristics of the elements of valve 370 are selected so that the resistance to flexing of flapper 376 overcomes the urging toward the position of engagement on valve seat 378 which results from the increased pressure of the gas in striker chamber 46 as striker 250 moves forward during firing from the cocked position to a position of impact on valve assembly 380, thereby maintaining valve 370 in the open state and permitting gas in striker chamber 46 to escape through valve 370. The characteristics of the elements of valve 370 are also selected so that the urging toward the position of engagement on valve seat 378 resulting from the much greater pressure of the charge of compressed gas released into striker chamber 46 by the opening of valve assembly 380 is sufficient to overcome the resistance to flexing of flapper 376, thereby forcing flapper 376 into sealing engagement with valve seat 378, closing valve 370 and preventing the escape of the charge of compressed gas from striker chamber 46.

As can be seen from the foregoing description, valve 360 provides unidirectional secondary valving comparable in result to that provided by valve 260. As can also be seen, valve 370 provides valved porting of striker chamber 46 comparable in result to that provided by valve 270.

In a third alternative embodiment (not illustrated), second pressure actuated valve 270 shown in FIG. 9 is relocated to provide both unidirectional secondary valving and valved porting of striker chamber 46. In the third alternative embodiment, chamber porting valve hole 299 is eliminated, and valve 270 is relocated to first valve frame hole 282 in place of valve 260. Valve 270 is oriented in hole 282 with lower orifice 273 forward, so that lower orifice 273 is in communication with valve body hole 85, and upper orifice 274 and second transverse port 275 are in communication with striker chamber 46. With valve 270 in this location, when striker 250 is moving forward to impact on valve assembly 280, gas can escape from striker chamber 46 by flowing in succession through valve 270; through vertical hole 85 and interchamber hole 23 shown in FIG. 3; past first reduced diameter portion 112 of bolt body 101, when it is in alignment with hole 23; and thence through projectile feed assembly 37 when it is in alignment with first reduced diameter portion 112; or through second reduced diameter portion 113 of bolt body 101, when it is in alignment with hole 23, and thence through vertical or horizontal transverse bore 108 or 109 and into longitudinal partial bore 110.

SUMMARY, RAMIFICATIONS AND SCOPE

It is now apparent that the objects previously set forth are attained in the invention. Efficiency in the utilization of propellent is improved by virtue of several features of the invention:

The valved porting of the striker chamber improves efficiency by permitting gas to escape as the striker is moving to impact on the primary valve assembly during firing, and by sealing against premature escape of the gas urging the striker back to the cocked position.

The unidirectional character of the secondary valve improves efficiency directly by eliminating a route by which gas can escape prematurely from the striker chamber.

The unidirectional character of the secondary valve improves efficiency indirectly by permitting the secondary channel to be larger, thereby permitting the period over which the primary valve assembly is open during firing to be shorter.

Recocking is achieved over a wider range of source gas pressures, with no significant increase in gun operating complexity, by virtue of variation in the ratio of the opening provided by the secondary valve relative to the opening provided by the main valve.

Maintenance is minimized by virtue of the main valve incorporating the single full pressure valve in the gun.

Although the description above contains many specificities, these should not be construed as limiting the scope of the invention but as merely providing illustrations of some of the presently preferred embodiments of the invention. For example, a cam mechanism, or pneumatic or electronic control, can be used to provide variation in the ratio of the opening provided by the secondary valve relative to the opening provided by the main valve; the configuration of the secondary valve, or of the main valve, can be changed to provide a different variation in the ratio of the opening provided by the secondary valve relative to the opening provided by the main valve; the main valve can have a different diameter than the secondary valve; valved porting of the striker chamber can be achieved by use of a valve incorporating a plate which slides to seal or unseal the valve; valved porting of the striker chamber can be opened or closed by cams associated with the movement of the striker; and valved porting of the striker chamber can be urged to the closed state by the rapid increase in pressure as compressed gas first enters the striker chamber.

The improvements provided by the invention are also applicable to guns in which a slot in the wall of the striker chamber, or other exhaust porting, permits compressed gas to exhaust from the striker chamber appreciably before recocking is completed; to guns which do not employ a bolt; to guns in which a bolt is not constrained to move with the striker but instead moves in response to the urging of compressed gas or a spring; to guns which incorporate a quantity other than two of longitudinal chambers within the gun frame; to automatic as well as semiautomatic guns; and to guns which by use of appropriate materials and manufacturing tolerances do not incorporate O-ring seals on a bolt or on a striker.

Thus the scope of the invention should be determined by the appended claims and their legal equivalents, rather than by the examples given.

Having described the invention, what is claimed is:

1. An improved gas powered gun comprising:
a frame;
a barrel mounted forward on the frame;
projectile feed means mounted to the frame for providing a projectile to the gun;
projectile feed sealing means for substantially preventing loss of gas through the projectile feed means;
a compressed gas reservoir;
a main valve for releasing gas from the compressed gas reservoir;
a striker chamber having an input port and an exhaust port;
a striker, slidable within the striker chamber between a cocked position and a position of impact on the main valve which impact actuates the main valve;
the striker effectively sealing the striker chamber when near the main valve;
bias means for urging the striker from the cocked position to the position of impact on the main valve;
trigger means;
a sear in the trigger means for releasably restraining the striker in the cocked position;
means for manually moving the striker to the cocked position;
a main channel having a main input port for receiving compressed gas released by the main valve,
a first output port for providing compressed gas to expel a projectile from the gun, and a second output port for providing compressed gas to the striker chamber input port;
wherein the improvement comprises:
a unidirectional secondary valve between the second output port of the main channel and the input port of the striker chamber for allowing compressed gas to pass into the striker chamber and preventing compressed gas from escaping from the striker chamber back to the main channel.

2. A gas powered gun as in claim 1 wherein the striker chamber exhaust port is closed by the striker except when the striker is substantially at the cocked position so that compressed gas within the striker chamber cannot escape until the striker is effectively returned to the cocked position.

3. A gas powered gun as in claim 1 wherein the secondary valve further comprises: means for actuating the secondary valve in concert with the main valve.

4. A gas powered gun as in claim 3 wherein the secondary valve opens at a rate which varies with the size of the opening differently than the main valve.

5. A gas powered gun as in claim 4 wherein the secondary valve opens at a rate which increases relative to the rate at which the main valve opens so that the ratio of the secondary valve opening to the main valve opening increases with increasing opening of the main and secondary valves.

6. A gas powered gun as in claim 4 wherein the secondary valve further comprises:
a first valve hole;
a second valve hole forming a valve hole intersection with the first valve hole; and
a contoured valve element matched to and moving into the first valve hole to close the secondary valve, and moving into the valve hole intersection to open the secondary valve.

7. A gas powered gun as in claim 6 wherein the contoured valve element has the form of a solid of revolution, and the first valve hole is circular in cross section and the second valve hole is circular in cross section.

8. A gas powered gun as in claim 6 wherein the contoured valve element further comprises:
a conical valve element; and
the first valve hole is circular in cross section; and
the second valve hole is circular in cross section.

9. A gas powered gun as in claim 6 wherein the second valve hole intersects the first valve hole orthogonally.

10. A gas powered gun as in claim 1 wherein the secondary valve further comprises:
pressure sensitive actuation means for opening the secondary valve when pressure in the main channel is greater than pressure in the striker chamber and closing the secondary valve when pressure in the striker chamber is greater than pressure in the main channel.

11. A gas powered gun as in claim 1 further comprising:
valved porting means for exhausting gas from the striker chamber which is open when the striker is moving toward the position of impact on the main valve, and which is closed when compressed gas in the striker chamber is urging the striker from the position of impact on the main valve to the cocked position.

12. A gas powered gun as in claim 11 wherein the striker further comprises:
the valved porting means.

13. A gas powered gun as in claim 12 wherein the valve porting means closes in response to impact on the main valve.

14. An improved gas powered gun comprising:
a frame;
a barrel mounted forward on the frame;
projectile feed means mounted to the frame for providing a projectile to the gun;
projectile feed sealing means for substantially preventing loss of gas through the projectile feed means;
a compressed gas reservoir;
a striker chamber;
a primary valve assembly for releasing gas from the compressed gas reservoir to expel a projectile from the gun and to charge the striker chamber;
a striker, slidable within the striker chamber between a cocked and a position of impact on the primary valve assembly which impact actuates the primary valve assembly;
the striker effectively sealing the striker chamber when the striker is near the primary valve assembly;
an exhaust port on the striker chamber for exhausting gas from the striker chamber when the striker is effectively at the cocked position;
bias means for urging the striker from the cocked position to the position of impact on the primary valve assembly;
trigger means;
a sear in the trigger means for releasably restraining the striker in the cocked position;
means for manually moving the striker to the cocked position;
wherein the improvement comprises:

valved porting means for exhausting gas from the striker chamber to a region outside of the striker chamber which is open when the striker is moving toward the position of impact on the main valve, and which is closed when compressed gas in the striker chamber is urging the striker from the position of impact on the main valve to the cocked position.

15. A gas powered gun as in claim 14 wherein the primary valve assembly further comprises:

a unidirectional charging valve in fluid communication with the striker chamber for allowing compressed gas to pass into the striker chamber and preventing compressed gas from escaping from the striker chamber.

16. A gas powered gun as in claim 14 wherein the striker further comprises:

the valved porting means.

17. A gas powered gun as in claim 14 wherein the valved porting means further comprises:

opening bias means for urging the valved porting means open;

means for urging the valved porting means to close in response to impact of the striker on the primary valve; and pressure sensitive means urging the valved porting means to remain closed in response to compressed gas in the striker chamber.

18. A gas powered gun as in claim 14 wherein the valved porting means further comprises:

opening bias means for constantly urging the valved porting means open; and pressure sensitive actuation means for urging the valved porting means closed when gas pressure is higher in the striker chamber than in the region outside of the striker chamber;

the pressure sensitive actuation means adapted to close the valved porting means when gas pressure is higher in the striker chamber than in the region outside of the striker chamber by a predetermined amount, so that the valved porting means is open when the striker is moving from the cocked position to the position of impact on the primary valve assembly, and is closed when the striker chamber is charged with compressed gas released by the primary valve assembly.

19. A gas powered gun as in claim 18 wherein the valved porting means further comprises:

an exhaust passageway having a striker chamber end in fluid communication with the striker chamber;

an outside end in fluid communication with the region outside of the striker chamber;

a valve seat intermediate the striker chamber end and the outside end; and wherein the pressure sensitive actuation means further comprises a movable element sealably engagable on the valve seat.

20. A gas powered gun as in claim 18 wherein the valved porting means further comprises:

an exhaust passageway having a striker chamber end in fluid communication with the striker chamber; and an outside end in fluid communication with the region outside of the striker chamber; and wherein the pressure sensitive actuation means further comprises a movable element sealably engagable on the striker chamber end of the exhaust passageway.

21. An improved gas powered gun comprising:

a frame;

a barrel mounted forward on the frame;

a projectile feed means mounted to the frame for providing a projectile to the gun;

bolt means for substantially sealing the projectile feed means against loss of gas;

a compressed gas reservoir;

a primary valve assembly adjacent the compressed gas reservoir for releasing gas from the compressed gas reservoir;

a striker chamber;

a striker, slidable within the striker chamber between a cocked position and a position of impact on the primary valve assembly which impact actuates the primary valve assembly;

the striker effectively sealing the striker chamber when near the primary valve assembly;

bias means for urging the striker from the cocked position to the position of impact on the primary valve assembly;

an exhaust port on the striker chamber for exhausting gas from the striker chamber when the striker is effectively at the cocked position;

trigger means;

a sear in the trigger means for releasably restraining the striker in the cocked position;

means for manually moving the striker to the cocked position;

the primary valve assembly further comprising a main poppet valve, and a valve body having a first valve body hole and a second valve body hole;

the first valve body hole having a reservoir end in fluid communication with the compressed gas reservoir and a striker chamber end in fluid communication with the striker chamber;

the valve body forming a main valve seat around the reservoir end of the first valve body hole;

the second valve body hole having a first hole end open to provide gas for expelling a projectile from the gun and a second hole end closed to the passage of gas, and forming a valve hole intersection with the first body hole;

the main poppet valve having a main poppet valve head in a usual main poppet valve position sealingly engaged with the main valve seat for controlling the release of gas from the reservoir, and an elongated main valve pin smaller than and axially translatable in the first valve body hole having a first valve pin end secured to the main poppet valve head and a second valve pin end in a usual main poppet valve position extending into the striker chamber to the position of impact by the striker, upon which the striker impacts causing the main valve pin to move away from the striker chamber and the main poppet valve to briefly open;

means urging the main poppet valve to close, returning the main poppet valve to the usual main poppet valve position;

wherein the improvement comprises:

a unidirectional secondary valve further comprising:

a secondary valve element on the main valve pin intermediate the valve hole intersection and the second end of the valve pin, and extending outward in the first valve body hole from the main valve pin effectively to the valve body, such that when the main valve pin moves away from the striker chamber by impact from the striker assembly the secondary valve element moves into the valve hole intersection, opening the secondary valve, and when the main valve pin is in the usual main valve pin position the secondary valve element is within the valve hole substantially closing the secondary valve.

22. A gas powered gun as in claim 21 wherein the secondary valve element on the main valve pin is conical in shape and tapers from a conical element base toward the second valve pin end, and the first valve body hole is circular in cross section and the second valve body hole is circular in cross section, such that motion of the main valve pin away from the usual main valve pin position opens the secondary valve at an increasing rate as the element moves farther into the valve hole intersection.

23. A gas powered gun as in claim 22 wherein the second valve body hole intersects the first valve body hole orthogonally.

24. A gas powered gun as in claim 21 further comprising valved porting means for exhausting gas from the striker chamber to a region outside of the striker chamber which is open when the striker is moving toward the position of impact on the main valve, and which is closed when compressed gas in the striker chamber is urging the striker from the firing position to the cocked position.

25. A gas powered gun as in claim 24 wherein the valved porting means further comprises:

the striker having a striker poppet valve.

26. A gas powered gun as in claim 25 wherein the striker poppet valve further comprises:

opening bias means for urging the striker poppet valve open;

means for urging the striker poppet valve to close in response to impact of the striker on the primary valve; and pressure sensitive means urging the striker poppet valve to remain closed in response to compressed gas in the striker chamber.

27. A gas powered gun as in claim 24 wherein the valved porting means further comprises:

opening bias means for constantly urging the valved porting means open; and pressure sensitive actuation means for urging the valved porting means closed when gas pressure is higher in the striker chamber than in the region outside of the striker chamber;

the pressure sensitive actuation means adapted to close the valved porting means when gas pressure is higher in the striker chamber than in the region outside of the striker chamber by a predetermined amount so that the valved porting means is open when the striker is moving from the cocked position to the position of impact on the primary valve assembly, and is closed when the striker chamber is charged with compressed gas released by the primary valve assembly.

* * * * *